US006429762B1

(12) United States Patent
Shusterman et al.

(10) Patent No.: US 6,429,762 B1
(45) Date of Patent: Aug. 6, 2002

(54) DATA COMMUNICATION ISOLATION TRANSFORMER WITH IMPROVED COMMON-MODE ATTENUATION

(75) Inventors: Boris Shusterman, Newton, MA (US); Alex Metsler, Foster City, CA (US); Abraham Thomas, Franklin, MA (US)

(73) Assignee: Compaq Information Technologies Group, L.P., Houston, TX (US)

( * ) Notice: Subject to any disclaimer, the term of this patent is extended or adjusted under 35 U.S.C. 154(b) by 0 days.

(21) Appl. No.: 08/912,417

(22) Filed: Aug. 18, 1997

(51) Int. Cl.[7] ..... H01F 27/06
(52) U.S. Cl. ..... 336/84 R; 336/84 M; 336/198
(58) Field of Search ..... 336/84 R, 84 C, 336/84 M, 212, 198, 200

(56) References Cited

U.S. PATENT DOCUMENTS

| | | | | | |
|---|---|---|---|---|---|
| 1,548,022 | A | * | 8/1925 | Casper et al. | 336/84 R |
| 1,695,122 | A | * | 12/1928 | Phillips | 336/84 R |
| 1,759,332 | A | * | 5/1930 | Whittle et al. | 336/84 R |
| 2,170,048 | A | * | 8/1939 | Dunning et al. | 336/84 R |
| 2,728,879 | A | * | 12/1955 | Erikson | 336/84 R |
| 2,904,762 | A | * | 9/1959 | Schulz | 336/84 R |
| 3,312,919 | A | * | 4/1967 | Ross | 336/84 R |
| 4,356,468 | A | * | 10/1982 | van Laar | 336/84 R |
| 4,518,941 | A | * | 5/1985 | Harada | 336/84 C |
| 5,952,849 | A | * | 9/1999 | Haigh | 326/82 |

FOREIGN PATENT DOCUMENTS

| | | | |
|---|---|---|---|
| JP | 11-204352 | * | 7/1999 |

* cited by examiner

*Primary Examiner*—Lincoln Donovan
*Assistant Examiner*—Tuyen T. Nguyen
(74) *Attorney, Agent, or Firm*—Conley, Rose & Tayon, P.C.

(57) ABSTRACT

A data communications isolation transformer uses an E—E core structure within an integrated circuit package. Two E-shaped core sections of the transformer fit together to form a core structure having a center portion and two outer portions. The center portion has twice the cross-sectional area of either of the outer portions. About the center portion fits a bobbin upon which a primary winding, a secondary winding and an electromagnetic interference shield are located. The shield lies between the two windings and attenuates common mode noise in the transformer. The shield is grounded to either the "chassis" side or the "logic" side of the apparatus. The shield may be a strip of conductive material, such as copper, or a thin conductive wire wound across the space between the primary winding and the secondary winding. The shield may also consist of two layers of conductive material between the primary and secondary windings, each of which is grounded to a different one of the chassis ground and the logic ground. The bobbin is made of a non-conductive material, and its use facilitates the making of the device by allowing obstruction-free wrapping of the primary and secondary windings, and of the shield.

21 Claims, 3 Drawing Sheets

DATA COMMUNICATION ISOLATION TRANSFORMER WITH IMPROVED COMMON-MODE ATTENUATION

FIELD OF THE INVENTION

This invention relates generally to the field of data communication isolation transformers and, more specifically, to isolation transformers with improved common-mode signal rejection.

DESCRIPTION OF THE RELATED ART

Pulse transformers are used extensively in networking. In data communication based on differential signaling, transformers are utilized to provide balanced data transfer over copper cables. Such transformers also perform the function of impedance matching between dedicated drivers and the impedance of the cable. These applications require the transformer to have broadband characteristics, so that the bandwidth of the useful signal will not be limited or distorted by the transformer.

Due to the demands of the combining high package density and low cost, transformers in networking interface modules are typically wound on small toroids. The construction is usually based on bifilar windings, where the primary and secondary windings are wound together. That is, the primary and secondary transformer windings lie adjacent to each other and are wound about the toroidal core together. This results in good coupling, minimizing leakage inductance. One notable disadvantage of this construction is the inherent high interwinding capacitance. A result of this capacitance is that common mode noise, which is superimposed on the differential signals, passes through the transformer and enters the I/O area where it can be radiated by the attached cables, causing electromagnetic interference (EMI). To reduce EMI, some means of common mode attenuation, such as common mode chokes, must be provided.

Typically, high performance magnetic modules are constructed using two small wound toroidal transformers and one or two common mode inductors within a package. The design packaging goal in applications of multiple twisted pair ports, when the ports (such as RJ45 connections) must be placed close to each other, is for transformers to follow the density of the port placement and to be positioned sideways, adjacent to each other. This construction leads to two parallel rows of toroidal components within the package. A disadvantage of this construction is that due to the placement of the toroids and resulting loose wire termination, there is an increased likelihood of cross talk.

It is therefore an object of this invention to provide a data communications transformer with better common mode rejection from the transformer itself, without the need for external common mode filtering.

SUMMARY OF THE INVENTION

In accordance with the present invention, a data communication isolation transformer is provided that uses an "E—E" or "double-E" core structure. The core has two E-shaped sections made of a material of relatively high magnetic permeability. When assembled, the two sections are located adjacent to, and in contact with, each other so as to form two flux paths through the core. The extending portions of each E-shaped section face each other such that the core has a center portion and two outer portions. Each of the flux paths through the core is through a different one of the outer core portions, and both are through the center portion. Since the center portion therefore supports twice the magnetic flux as the outer portions, it is preferable to have a center portion which has a cross-sectional area that is twice the cross-sectional area of either of the outer portions.

Mountable on the center portion of the core is a non-conductive bobbin, which fits snugly over the surface of the center core portion. The bobbin serves as a surface upon which the coils of the transformer may be wound, without the obstruction of the various portions of the core. The primary winding lies adjacent to the surface of the bobbin, and further from the bobbin surface is the secondary winding. This arrangement of primary and secondary windings allows an electromagnetic shield to be located between them. Thus, wrapped about the bobbin, between the primary and secondary windings is a shield of conductive material. The shield is electrically grounded to either the "chassis" side or the "logic" side of the apparatus in which the transformer is to be used. The shield attenuates common mode noise within the transformer, and may be either a thin piece of conductive material, such as copper foil, or a thin copper wire wound about the bobbin in the space between the primary and secondary windings. The shield may also consist of two separate layers (i.e. two pieces of conductive material or two wound wires) between the primary and secondary windings, one of which is grounded to the "logic" side of the apparatus, while the other is grounded to the "chassis" side.

The bobbin may be made of a non-conductive material such as paper tubing and, after placing the primary and secondary windings and the shield on the bobbin, the transformer core is assembled with the bobbin located on the center core portion. The entire transformer structure is then located within a standard IC package, with the leads of the primary and secondary windings, and the ground path for the shield, electrically connected to the mounting pins of the IC. This allows easy circuit board fabrication, mounting the transformer on the circuit board in the same manner as any other ICs. Since common mode attenuation is provided by the EMI shield of the transformer, it is not necessary to use a separate common mode choke, which would otherwise typically be located within the IC package. This significantly reduces the number of components in the IC package.

DETAILED DESCRIPTION OF THE PREFERRED EMBODIMENT

Figure 1:
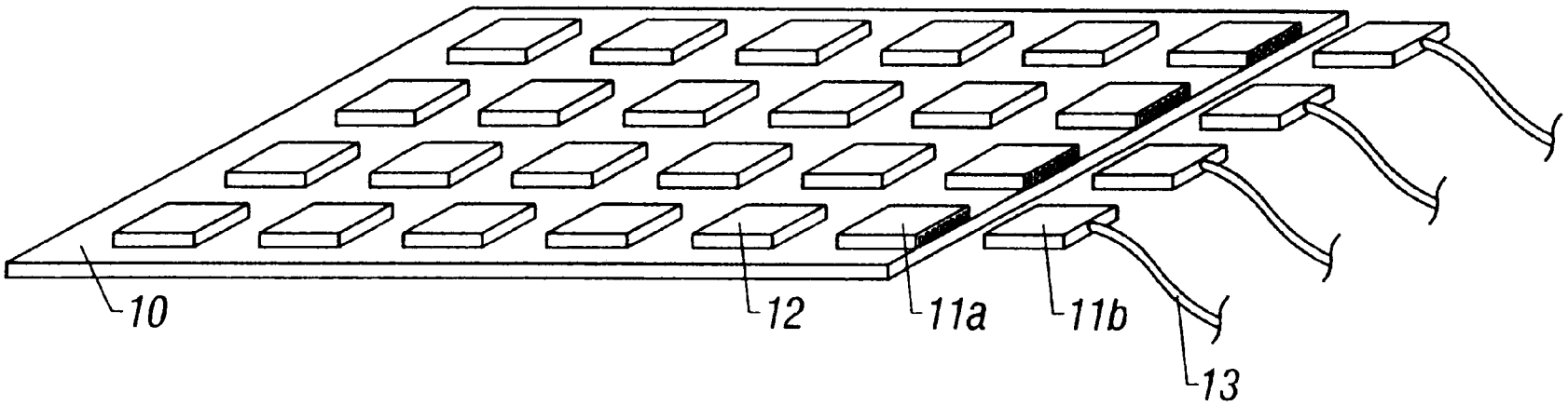
FIG. 1 is a perspective schematic view of a printed circuit board on which may be mounted an isolation transformer according to the present invention.

Shown in FIG. 1 is a schematic view of a typical printed circuit (PC) board 10, as might be used with a data transmission system. Among the components mounted on the board is an isolation transformer 12 according to the present invention. The transformer may be connected via the circuit paths of the PC board to an external system via an edge connector 11*a*. A cable connector 11*b* that plugs into the edge connector 11*a* provides an electrical communication path to cable 13. For space considerations and convenience, the transformer 12 is located within a typical integrated circuit (IC) package, which is then mounted on the PC board in a conventional manner, along with other components of the system. Leads from the transformer are preferably connected to other components of the system via pins on the transformer IC package, thus simplifying the manufacturing process.

Figure 2:
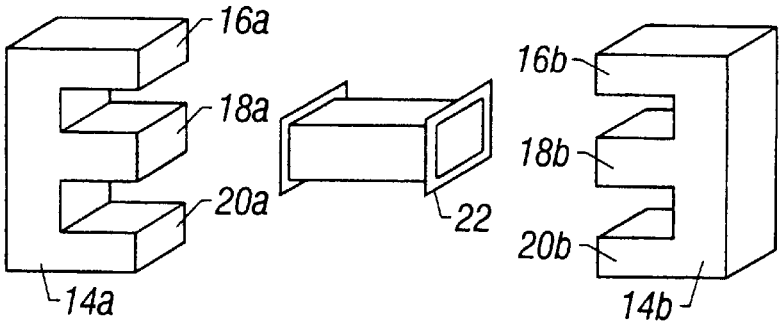
FIG. 2 is an exploded perspective view of the core and bobbin of an isolation transformer according to the present invention.

Unlike conventional isolation transformers, the transformer 12 uses a core structure which allows for EMI shielding between the primary and secondary windings of the transformer, thus removing the need for an external common mode attenuator. The core of the transformer 12 may be ferrite, as is typical in transformer construction, and uses a "double-E" or "E—E" type structure, which is depicted in the exploded isometric view of FIG. 2. As shown, a core section 14*a* is shaped like the letter "E", as is a second core section 14*b*. The two core sections are essentially identical, each having three posts which contact the other core sections (the posts are identified in FIG. 2 as 16*a*, 18*a*, and 20*a* for core portion 14*a*, and as 16*b*, 18*b*, and 20*b* for core portion 14*b*). When fitted together, the two core sections 14*a*, 14*b* form the core of the transformer 12. Specifically, post 16*a* contacts post 16*b* to form one outer portion (generally referred to herein as 16), post 18*a* contacts post 18*b* to form a center portion (generally referred to herein as 18) and post 20*a* contacts post 20*b* to form a second outer portion (generally referred to herein as 20).

The primary and secondary windings of the transformer 12 are located about the center section 18 of the core. However, to simplify the winding of the transformer, a bobbin 22 is used which fits over the center portion of the transformer core. Prior to locating the bobbin 22 on the center portion of the transformer, the primary and secondary coils of the transformer are wound on the bobbin. Since there is no obstruction from the core to winding these wires on the bobbin, the winding operation is relatively simple, and can be easily automated. The absence of obstruction also allows the installation of an EMI shield between the primary and secondary windings.

Figure 3:
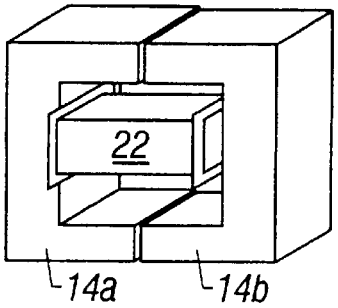
FIG. 3 is an assembled perspective view of the transformer of FIG. 2.
Figure 4:
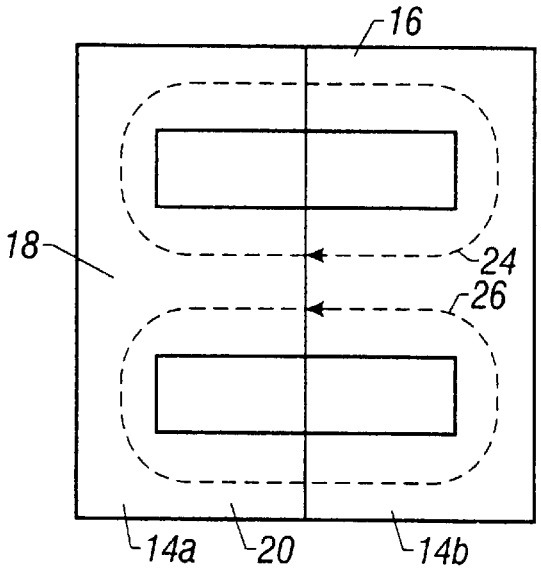
FIG. 4 is a schematic cross sectional view of the assembled core of the transformer of FIG. 2 showing the magnetic flux paths through the core.

After the bobbin and transformer core are assembled, the structure appears as shown in the isometric view of FIG. 3. For clarity, neither FIG. 2 nor FIG. 3 depicts the wires of the secondary transformer winding. However, those skilled in the art will recognize that in each of FIGS. 3 and 4, the secondary winding of the transformer is wound about the bobbin, and ordinarily would be viewable from the perspective of these figures.

When assembled as shown in FIG. 3, the primary and secondary windings (given the appropriate current direction for each) have flux paths which coincide within the center portion of the transformer core. This is demonstrated by the schematic cross-sectional front view of the transformer core in FIG. 4. As shown, the magnetic coupling between the two windings is provided by the flux paths for each winding passing through the center portion of the core. For example, the flux path for the primary winding may be that indicated by dashed line 24, while the flux path for the secondary winding may be that indicated by the dashed line 26 (although those skilled in the art will recognize that the flux direction depends on the winding direction of the primary and secondary coils). In the preferred embodiment, the center portion 18 of the core has twice the cross sectional area of each of the outer portions 16 and 20. This allows for the desired flux density in the core, with all of the magnetic flux passing through the center portion 18, and half of the total flux density passing through each of the outer portions 16 and 20. Thus, the desired magnetic coupling between primary and secondary is provided by the "E—E" structure of the transformer core.

Figure 5:
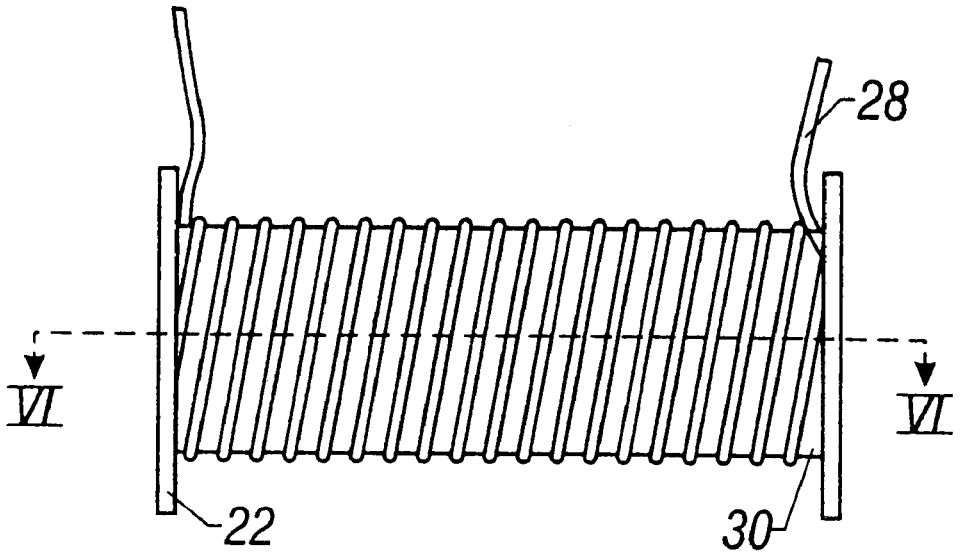
FIG. 5 is a side view of the bobbin of the transformer of FIG. 2 showing the shield and secondary winding of the transformer.

Unlike prior art isolation transformers, which use a toroidal core construction, the core structure of the transformer coil of the present invention allows for EMI shielding to be incorporated into the transformer itself. FIG. 5 is a front view of the bobbin 22 of the transformer. On the outer surface of the bobbin 22 is the secondary winding of the transformer which consists of wire 28 wrapped about the bobbin spool. Beneath the secondary winding 28 is EMI shield 30, which separates the secondary winding from the primary winding. The shield may be a thin strip of conductive material, preferably copper foil. Using a strip of material for the shield simplifies the manufacture of the bobbin 22, and provides a continuous shield surface between the primary winding and the secondary winding. The shield is electrically connected (i.e. grounded) to either the "logic" side or the "chassis" side of the apparatus since, depending on the application, either will allow the shield to provide the necessary common mode noise attenuation. Alternatively, the shield may consist of two layers (i.e. two strips of material or two layers of wound wire) one of which is grounded to the "logic" side of the apparatus, while the other is grounded to the "chassis" side. This improves the EMI shielding capabilities of the transformer, but increases the separation between the two windings, providing a relatively higher leakage inductance of the transformer.

Figure 6:
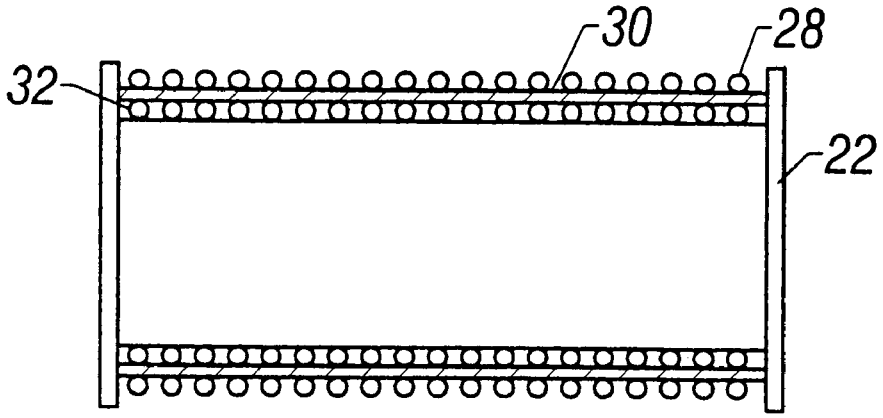
FIG. 6 is a longitudinal cross section of the bobbin of FIG. 5 showing the primary and secondary windings of the transformer and the shielding therebetween.

FIG. 6 is a lengthwise cross sectional view of the bobbin 22 of FIG. 5. In this view, primary winding 32 is shown between the shield 30 and the surface of spool 22. Like secondary winding 28, primary winding 32 consists of a wire wrapped around the bobbin spool. Much of the magnetic coupling is directly from one winding to the next. Thus, since the shield requires a physical separation between the two windings, it also contributes to an increase in the leakage inductance of the transformer, relative to what it would be if the windings were immediately adjacent to each other. However, use of the shield also provides the desired common mode attenuation. In one variation of the present embodiment, the shield consists of a contiguous layer of fine copper wire wound about the bobbin between the primary and secondary windings. Using a wound wire as the shield allows more efficient use of the space between the windings, thereby reducing the separation between the two windings and helping to minimize the leakage inductance. However, this construction also increases the complexity of the manufacturing process, and results in a shield which lacks the continuous flat surface of the copper strip shield, and which is slightly less effective as an EMI shield than the flat surface shield.

In the preferred embodiment, the bobbin 22 is constructed of plastic, and may be, for example, injection molded. The bobbin is sized to fit snugly about the center posts 18*a*, 18*b* of the transformer core, so as to minimize the distance between the transformer windings and the center portion of the core. After the shield and transformer windings are wrapped about the center of the core, the two halves of the core structure are assembled, with the posts 16*a* and 16*b*, posts 18*a* and 18*b*, and posts 20*a* and 20*b* being pressed into close contact, respectively. The small gaps which will necessarily exist between the two core portions 14*a*, 14*b* helps to prevent the possibility of core saturation under DC conditions. The assembled isolation transformer is then located within an appropriately-sized IC package, such as IC 12 shown in FIG. 1, and the leads from the primary and secondary windings are connected to the pins of the IC. It is expected that the simplicity in assembling the transformer of the present invention will lend itself to automation, allowing cheap and fast mass production of the transformer components.

While the invention has been shown and described with regard to a preferred embodiment thereof, those skilled in the art will recognize that various changes in form and detail may be made herein without departing from the spirit and scope of the invention as defined by the appended claims.

What is claimed is:

1. A data communication isolation transformer comprising:

a transformer core with a relatively high magnetic permeability, the core including two E-shaped sections adjacent to and in contact with each other so as to form two flux paths through the core, each of which passes through a center portion of the core;

a bobbin that is mountable on the center portion of the core; the primary winding wound about the bobbin;

a secondary winding wound about the bobbin; and an electromagnetic shield located between the primary winding and the secondary winding;

wherein the core, bobbin, primary winding, secondary winding and shield together being located within an integrated circuit (IC) package and used for the purpose of data communication isolation.

2. A transformer according to claim 1 wherein the IC package comprises mounting pins to which the primary winding and secondary winding are electrically connected.

3. A transformer according to claim 1 wherein the shield comprises a thin piece of conductive material.

4. A transformer according to claim 1 wherein the shield comprises a thin conductive wire wound about the bobbin in the space between the primary winding and the secondary winding.

5. A transformer according to claim 1 wherein the shield comprises copper.

6. A transformer according to claim 1 wherein, together with the center portion of the core, two outer portions of the core make up said flux paths through the core, and wherein the center portion of the core has a cross-sectional area which is substantially twice the cross-sectional area of either of the outer core portions.

7. A transformer according to claim 1 wherein the bobbin comprises a non-conductive material.

8. A transformer according to claim 7 wherein the bobbin comprises paper tubing.

9. A transformer according to claim 1 wherein the shield is electrically connectable to an electrical ground of a system in which the transformer is used.

10. A transformer according to claim 1 wherein the shield comprises two layers of conductive material.

11. A transformer according to claim 10 wherein a first one of the shields is electrically connectable to an electrical chassis ground, while a second one of the shields is electrically connectable to a logic ground of a system in which the transformer is used.

12. A transformer according to claim 1 wherein the shield comprises two layers of conductive material.

13. A transformer according to claim 12 wherein a first one of the shields is electrically connectable to an electrical chassis ground, while a second one of the shields is electrically connectable to a logic ground of a system in which the transformer is used.

14. A data communication isolation transformer comprising:

a transformer core with a relatively high magnetic permeability, the core including two E-shaped sections adjacent to and in contact with each other so as to form two flux paths through the core, each of which passes through a center portion of the core;

a non-conductive bobbin that is mountable on the center portion of the core;

a primary winding wound about the bobbin;

a secondary winding wound about the bobbin;

an electromagnetic shield of conductive material located between the primary winding and the secondary winding; and an integrated circuit (IC) package within which the core, bobbin, primary winding, secondary winding and shield are located, the IC package including mounting pins to which the primary winding and secondary winding are electrically connected;

wherein said transformer issued for the purpose of data communication.

15. A transformer according to claim 14 wherein the shield comprises a thin piece of conductive material.

16. A transformer according to claim 14, wherein the shield comprises a thin conductive wire wound about the bobbin in the space between the primary winding and the secondary winding.

17. A transformer according to claim 14 wherein the shield is electrically connectable to an electrical ground of a system in which the transformer is used.

18. A transformer according to claim 14 wherein the shield comprises copper.

19. A transformer according to claim 14 wherein, together with the center portion of the core, two outer portions of the core make up said flux paths through the core, and wherein the center portion of the core has a cross-sectional area which is substantially twice the cross-sectional area of either of the outer core portions.

20. A transformer according to claim 14 wherein the bobbin comprises paper tubing.

21. A data communication isolation transformer comprising:

a transformer core with a relatively high magnetic permeability, the core including two E-shaped sections adjacent to and in contact with each other so as to form two flux paths through the core, the flux paths each passing through one of two outer portions of the core and both passing through a center portion of the core, and wherein the center portion of the core has a crosssectional area which is substantially twice the cross-sectional area of either of the outer core portions;

a non-conductive bobbin that is mountable on the center portion of the core;

a primary winding wound about the bobbin;

a secondary winding would about the bobbin;

an electromagnetic shield of conductive material located between the primary winding and the secondary winding, the shield being electrically connectable to an electrical ground of a system in which the transformer is used ; and an integrated circuit (IC) package within which the core, bobbin, primary winding, secondary winding, and shield are located, the IC package including mounting pins to which the primary winding and secondary winding are electrically connected;

wherein the transformer is used for the purpose of data communication isolation.

* * * * *

UNITED STATES PATENT AND TRADEMARK OFFICE

CERTIFICATE OF CORRECTION

PATENT NO. : 6,429,762 B1
APPLICATION NO. : 08/912417
DATED : August 6, 2002
INVENTOR(S) : Boris Shusterman et al.

It is certified that error appears in the above-identified patent and that said Letters Patent is hereby corrected as shown below:

Column 5, line 30, change “the space” to read --a space--;

Column 5, line 53, change “claim 1” to read --claim 14--;

Column 6, line 21, change “the space” to read --a space--; and

Column 6, line 51, change “winding would about” to read --winding wound about--.

Signed and Sealed this

Third Day of June, 2008

JON W. DUDAS
*Director of the United States Patent and Trademark Office*